US008615392B1

(12) United States Patent
Goodwin

(10) Patent No.: US 8,615,392 B1
(45) Date of Patent: Dec. 24, 2013

(54) SYSTEMS AND METHODS FOR PRODUCING AN ACOUSTIC FIELD HAVING A TARGET SPATIAL PATTERN

(75) Inventor: Michael M. Goodwin, Scotts Valley, CA (US)

(73) Assignee: Audience, Inc., Mountain View, CA (US)

( * ) Notice: Subject to any disclaimer, the term of this patent is extended or adjusted under 35 U.S.C. 154(b) by 567 days.

(21) Appl. No.: 12/893,208

(22) Filed: Sep. 29, 2010

Related U.S. Application Data

(60) Provisional application No. 61/266,128, filed on Dec. 2, 2009.

(51) Int. Cl.
*G10L 21/00* (2013.01)

(52) U.S. Cl.
USPC ..... 704/206; 381/337

(58) Field of Classification Search
USPC ..... 704/200–230, 500–504; 381/55, 71.7, 381/77.8, 337
See application file for complete search history.

(56) References Cited

U.S. PATENT DOCUMENTS

| | | | | |
|---|---|---|---|---|
| 4,025,724 | A * | 5/1977 | Davidson et al. | 381/71.2 |
| 4,802,227 | A * | 1/1989 | Elko et al. | 381/92 |
| 5,715,319 | A * | 2/1998 | Chu | 381/26 |
| 2003/0147538 | A1 * | 8/2003 | Elko | 381/92 |
| 2005/0267369 | A1 * | 12/2005 | Lazenby et al. | 600/447 |
| 2007/0003097 | A1 * | 1/2007 | Langberg et al. | 381/386 |

* cited by examiner

*Primary Examiner* — Abul Azad
(74) *Attorney, Agent, or Firm* — Carr & Ferrell LLP

(57) ABSTRACT

The present technology provides a sophisticated level of control of the spatial pattern of an acoustic field which can overcome or substantially alleviate problems associated with transmitting an acoustic signal within the near-end acoustic environment. The spatial pattern is produced by utilizing an array of audio transducers which generate a plurality of acoustic waves forming an acoustic interference pattern, such that the resultant acoustic energy is constrained (e.g. limited to an acoustic energy level at or below a predetermined threshold level) in one or more regions of the spatial pattern. In doing so, listeners in these region(s) may not receive sufficient acoustic energy to hear the associated acoustic signal, while listeners in other regions can. Similarly, these techniques can suppress echo paths within those region(s).

20 Claims, 8 Drawing Sheets

SYSTEMS AND METHODS FOR PRODUCING AN ACOUSTIC FIELD HAVING A TARGET SPATIAL PATTERN

CROSS REFERENCE TO RELATED APPLICATIONS

This application claims the benefit of U.S. Provisional Application No. 61/266,128, filed on Dec. 2, 2009, entitled "Loudspeaker Focusing", which is incorporated by reference herein.

BACKGROUND

1. Field of the Invention

The present invention related generally to audio processing, and more particularly to producing an acoustic field having a target spatial pattern.

2. Description of Related Art

Various types of audio devices such as cellular phones, laptop computers and conferencing systems present an acoustic signal through one or more speakers of the audio device, so that one or more acoustic waves are generated, which when superimposed form an acoustic field proximate to the audio device. The acoustic field formed by the generated acoustic waves can then be received by an ear of a person who is an intended listener, so that the acoustic signal is heard.

However, typically the acoustic waves originating from the audio device will also travel in other directions within the near-end acoustic environment than toward the intended listener, and may combine to form an acoustic field having significant energy in regions other than where the intended listener is situated. This can be undesirable for a number of reasons. For example, other people within the near-end acoustic environment may also hear the acoustic signal, which can be annoying to them. In addition, in some instances the acoustic signal may contain information intended to be heard only by the intended listener, such as a user of the audio device. Thus, transmitting the acoustic wave throughout the near-end acoustic environment may limit the usefulness of such audio devices in certain instances.

In addition, transmitting the acoustic wave throughout the near-end acoustic environment can result in the problem of acoustic echo, which is a delayed and distorted version of an original sound reflected back to its source. In a typical conversation, a far-end acoustic signal of a remote person speaking at the "far-end" is transmitted over a network to an audio device of a person listening at the "near-end." When the far-end acoustic signal is presented through the loudspeaker of the audio device, part of this acoustic wave may be reflected via an echo path to a microphone or other acoustic sensor of the audio device. This reflected signal may then be processed by the audio device and transmitted back to the remote person, resulting in echo. As such, the remote person will hear a delayed and distorted version of their own speech, which can interfere with normal communication and is annoying.

It is therefore desirable to provide systems and methods for producing an acoustic field which can overcome or substantially alleviate problems associated with transmitting the acoustic signal to the intended listener, such as those described above.

SUMMARY

The present technology provides a sophisticated level of control of the spatial pattern of an acoustic field which can overcome or substantially alleviate problems associated with transmitting an acoustic signal within the near-end acoustic environment. The spatial pattern is produced by utilizing an array of audio transducers which generate a plurality of acoustic waves forming an acoustic interference pattern (i.e., an acoustic field), such that the resultant acoustic energy is constrained (e.g., limited to an acoustic energy level at or below a predetermined threshold level) in one or more regions of the spatial pattern. In doing so, listeners in these region(s) may not receive sufficient acoustic energy to hear and comprehend the acoustic signal associated with the acoustic field, while listeners in other regions can. Similarly, these techniques can suppress echo paths within those region(s).

In embodiments, a multi-faceted analysis may also be carried out to determine the direction of a desired listener of the acoustic signal associated with the acoustic field relative to the orientation of the array of audio transducers. The spatial pattern can then be automatically and dynamically adjusted in real-time based on this direction of the desired listener. This adjustment may include maximizing the acoustic energy of the acoustic field in the region which includes the determined direction of the desired listener. In doing so, the techniques described herein can increase the quality and robustness of the listening experience of the desired listener, regardless of the location of the desired listener. In some alternative embodiments the direction of the desired listener may be fixed.

A method for producing an acoustic field having a target spatial pattern as described herein includes receiving a first acoustic signal. Signal modifications are then applied to the first acoustic signal to form corresponding modified acoustic signals. The signal modifications are based on a constraint for the acoustic field in a particular region of the target spatial pattern. The modified acoustic signals are provided to corresponding audio transducers in a plurality of audio transducers to generate a plurality of acoustic waves. The plurality of acoustic waves produces the acoustic field with the target spatial pattern.

A system as described herein for producing an acoustic field having a target spatial pattern includes an audio processing system to receive a first acoustic signal. The audio processing system also applies signal modifications to the first acoustic signal to form corresponding modified acoustic signals. The signal modifications are based on a constraint for the acoustic field in a particular region of the target spatial pattern. A plurality of audio transducers then generates a plurality of acoustic waves in response to the modified acoustic signals. The plurality of acoustic waves produces the acoustic field with the target spatial pattern.

A computer readable storage medium as described herein has embodied thereon a program executable by a processor to perform a method for producing an acoustic field having a target spatial pattern as described above.

Other aspects and advantages of the present invention can be seen on review of the drawings, the detailed description, and the claims which follow.

DETAILED DESCRIPTION

The present technology provides a sophisticated level of control of the spatial pattern of an acoustic field which can overcome or substantially alleviate problems associated with transmitting an acoustic signal within the near-end acoustic environment. The spatial pattern is produced by utilizing an array of audio transducers which generate a plurality of acoustic waves forming an acoustic interference pattern, such that the resultant acoustic energy is constrained (e.g., limited to an acoustic energy level at or below a predetermined threshold level) in one or more regions of the spatial pattern. In doing so, listeners in these region(s) may not receive sufficient acoustic energy to hear and comprehend the acoustic signal associated with the acoustic field, while listeners in other regions can. Similarly, these techniques can suppress echo paths within those region(s).

In embodiments, a multi-faceted analysis may also be carried out to determine the direction of a desired listener of the associated acoustic signal relative to the orientation of the array of audio transducers. The spatial pattern can then be automatically and dynamically adjusted in real-time based on this direction of the desired listener. This adjustment may include maximizing the acoustic energy of the acoustic field in the region which includes the determined direction of the desired listener. In doing so, the techniques described herein can increase the quality and robustness of the listening experience of the desired listener, regardless of the location of the desired listener. In some alternative embodiments, the direction of the desired listener may be fixed.

Embodiments of the present technology may be practiced on any audio transducer-based device that is configured to receive and/or provide audio such as, but not limited to, cellular phones, laptop computers, conferencing systems, automobile systems. While some embodiments of the present technology will be described in reference to operation of a laptop computer, the present technology may be practiced on any audio device.

Figure 1:
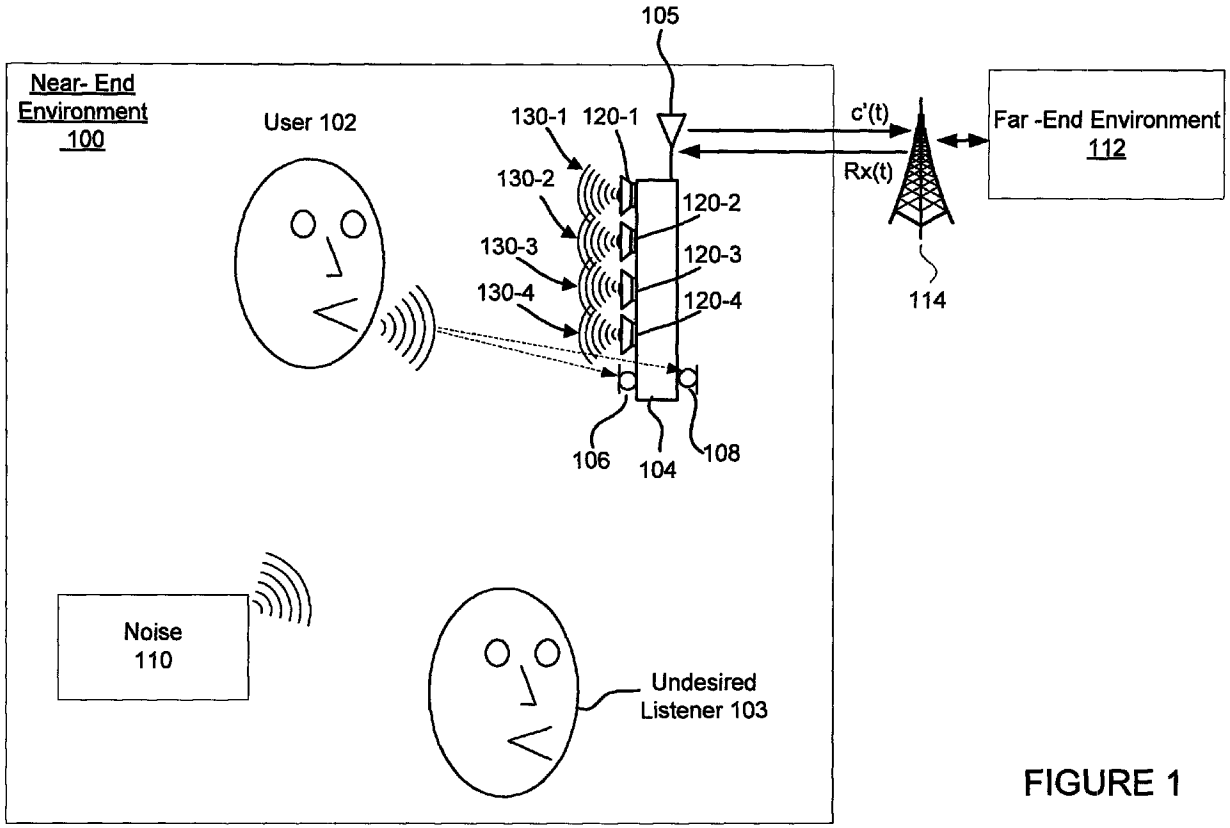
FIG. 1 is an illustration of an environment in which embodiments of the present technology may be used.

FIG. 1 is an illustration of an environment in which embodiments of the present technology may be used. An audio device 104 may act as a source of audio content for a user 102 in a near-end environment 100 (also referred to herein as near-end acoustic environment 100). In the illustrated embodiment, the audio content provided by the audio device 104 includes a far-end acoustic signal Rx(t) wirelessly received over a communications network 114 via an antenna device 105. More generally, the far-end acoustic signal Rx(t) may be received via one or more wired links, wireless links, combinations thereof, or any other mechanism for the communication of information. The far-end acoustic signal Rx(t) comprises speech from the far-end environment 112, such as speech of a remote person talking into a second audio device. As used herein, the term "acoustic signal" refers to a signal derived from an acoustic wave corresponding to actual sounds, including acoustically derived electrical signals which represent an acoustic wave. For example, the far-end acoustic signal Rx(t) is an acoustically derived electrical signal that represents an acoustic wave in the far-end environment 112. The far-end acoustic signal Rx(t) can be processed to determine characteristics of the acoustic wave such as acoustic frequencies and amplitudes.

Alternatively, the audio content provided by the audio device 104 may for example be stored on a storage media such as a memory device, an integrated circuit, a CD, a DVD, etc for playback to the user 102.

The exemplary audio device 104 includes a primary microphone 106, a secondary microphone 108 which may be optional in some embodiments, audio transducers 120-1 to 120-4, and an audio processing system (not illustrated in FIG. 1) for producing an acoustic field within the near-end environment 100 having a target spatial pattern using the techniques described herein. The audio transducer 120-1 generates an acoustic wave 130-1 within the near-end acoustic environment 100. Similarly, the audio transducer 120-2 generates an acoustic wave 130-2, the audio transducer 120-3 generates an acoustic wave 130-3, and the audio transducer 120-4 generates an acoustic wave 130-4. Each of the audio transducers 120-1 to 120-4 may for example be a loudspeaker, or any other type of audio transducer which generates an acoustic wave in response to an electrical signal.

In the illustrated embodiment, the audio device 104 includes four audio transducers 120-1 to 120-4. More generally, the audio device 104 may include two or more audio transducers such as for example two, three, four, five, six, seven, eight, nine, ten or even more audio transducers.

The acoustic field generated by the audio device 104 is a superposition of the acoustic waves 130-1 to 130-4. In other words, the acoustic waves 130-1 to 130-4 form an acoustic interference pattern within the near-end environment 100 to produce the acoustic field. As described herein, the acoustic waves 130-1 to 130-4 are configured to constructively and destructively interfere with one another within the near-end environment to form a target spatial pattern for the acoustic field.

As described below, the audio device 104 presents the far-end acoustic signal Rx(t) (or other desired acoustic signal) to the user 102 in the form of modified acoustic signals y(t). These modified acoustic signals y(t) are then provided to the audio transducers 120-1 to 120-4 to generate the acoustic waves 130-1 to 130-4. The audio processing system applies signal modifications (e.g. filters, weights, time delays, etc.) to form these modified acoustic signals y(t) such that the acoustic field resulting from the superposition of acoustic waves 130-1 to 130-4 has the target spatial pattern. In some embodiments, the target spatial pattern of the acoustic field is defined in terms of one or more spatial regions where the acoustic signal is to be delivered with maximal energy and one or more regions where the resultant acoustic energy is constrained (e.g., reduced or removed due to destructive interference) to be at or below a certain threshold. In some alternative embodiments, the target spatial pattern of the acoustic field may alternatively or further be defined in terms of minimizing energy delivered to certain regions subject to the constraint that the energy delivered to other regions is at or above a certain threshold. In doing so, listeners in these low acoustic energy region(s), such as undesired listener 103, may not receive sufficient acoustic energy to hear the audio content provided by the audio device 104, while an intended listener can.

Similarly, the acoustic waves 130-1 to 130-4 may be configured to destructively interfere in the direction of an echo path to one or more of the microphones 106, 108 (microphone 106 is also referred to herein as primary microphone 106 and first reference microphone 106, and microphone 108 is also referred to as secondary microphone 108 and secondary reference microphone 108). In such a case, the acoustic energy of the acoustic field that is picked up by the microphones 106, 108 can be small, thereby alleviating or overcoming the problems associated with acoustic echo.

In the illustrated embodiment, the exemplary audio device 104 includes two microphones: a primary microphone 106 relative to the user 102 and a secondary microphone 108 located a distance away from the primary microphone 106. Alternatively, the audio device 104 may include one or more microphones, such as for example one, two, three, four, five, six, seven, eight, nine, ten or even more microphones.

The primary microphone 106 and secondary microphone 108 may be omni-directional microphones. Alternatively embodiments may utilize other forms of microphones or acoustic sensors.

While the microphones 106 and 108 receive sound (i.e. acoustic signals) from the user 102, the microphones 106 and 108 also pick up noise 110. Although the noise 110 is shown coming from a single location in FIG. 1, the noise 110 may include any sounds from one or more locations that differ from the location of the user 102, and may include reverberations and echoes. The noise 110 may be stationary, non-stationary, and/or a combination of both stationary and non-stationary noise. The signal received by the primary microphone 106 is referred to herein as a primary acoustic signal c(t). The signal received by the secondary microphone 108 is referred to herein as the secondary acoustic signal f(t).

As described below, the direction of the user 102 (or other desired listener of the acoustic signal associated with the acoustic field) may be derived based on the differences (e.g. energy and/or phase differences) between the primary acoustic signal c(t) and the secondary acoustic signal f(t). Due to the spatial separation of the primary microphone 106 and the secondary microphone 108, the primary acoustic signal c(t) may have an amplitude and a phase difference relative to the secondary acoustic signal f(t). These differences can be used to determine the direction of the user 102. The spatial pattern of the acoustic field can then be automatically and dynamically adjusted in real-time based on this direction of the user 102. This adjustment may include maximizing the acoustic energy of the acoustic field in the region which includes the determined direction of the user while maintaining a constraint on the acoustic energy in one or more regions, for instance the region where the undesired listener 103 is located. In doing so, the techniques described herein can increase the quality and robustness of the listening experience of the user 102, regardless of their location.

In the illustrated example, the primary microphone 106 is closer to the user 102 than the secondary microphone 108. As a result, the intensity level of speech from the user 102 is higher at the first reference microphone 106 than at the secondary microphone 108, resulting in a larger energy level received by the primary microphone 106. Further embodiments may use a combination of energy level differences and time delays to determine the location of the user 102. Further embodiments may use an image capture device such as a video camera on the audio device 104 to determine the location of the user 102. In such a case, the images provided by the image capture device may be analyzed to determine the relative location of the user 102.

In various embodiments, where the primary and secondary reference microphones 106, 108 are omni-directional microphones that are closely-spaced (e.g., 1-2 cm apart), a beamforming technique may be used to simulate a pair of forwards-facing and backwards-facing directional microphones. The level difference between the outputs of this pair of microphones may be used to determine the direction of the user 102, which can then be used to adjust the acoustic field in real-time using the techniques described herein.

As described below, the audio device 104 may also process the primary acoustic signal c(t) to reduce noise and/or echo. A noise and echo reduced acoustic signal c'(t) may then be transmitted by the audio device 104 to the far-end environment 112 via the communications network 114.

Figure 2:
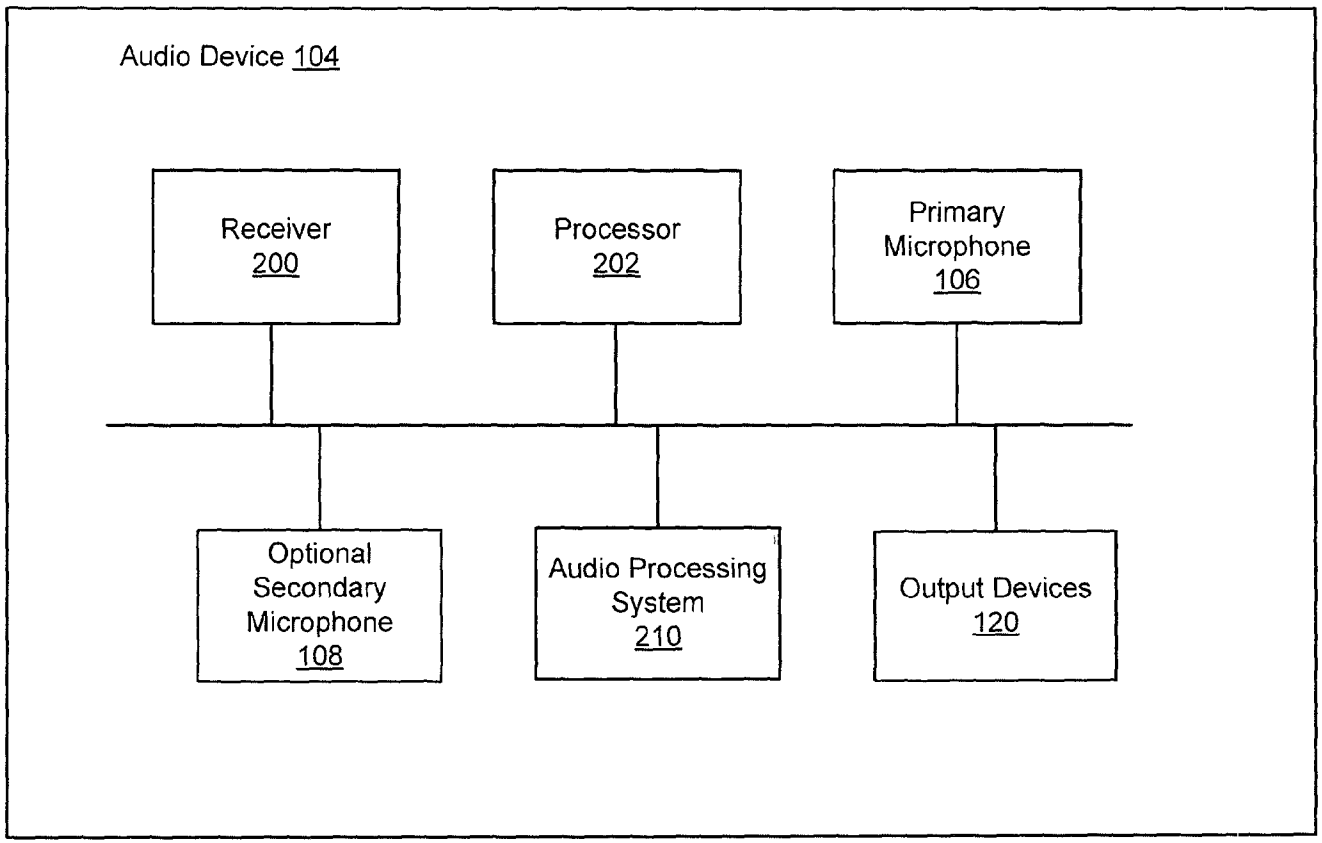
FIG. 2 is a block diagram of an exemplary audio device.

FIG. 2 is a block diagram of an exemplary audio device 104. In the illustrated embodiment, the audio device 104 includes a receiver 200, a processor 202, the primary microphone 106, an optional secondary microphone 108, an audio processing system 210, and output devices such as audio transducers 120-1 to 120-4. The audio device 104 may include further or other components necessary for audio device 104 operations. Similarly, the audio device 104 may include fewer components that perform similar or equivalent functions to those depicted in FIG. 2.

Processor 202 may execute instructions and modules stored in a memory (not illustrated in FIG. 2) in the audio device 104 to perform functionality described herein, including producing an acoustic field having a target spatial pattern. Processor 202 may include hardware and software implemented as a processing unit, which may process floating point operations and other operations for the processor 202.

The exemplary receiver 200 is configured to receive the far-end acoustic signal Rx(t) from the communications network 114. In some embodiments, the receiver 200 may include the antenna device 105. The far-end acoustic signal Rx(t) may then be forwarded to the audio processing system 210, which processes the signal Rx(t) to produce the acoustic field to present the signal Rx(t) to the user 102 or other desired listener using the techniques described herein. In some embodiments, the audio processing system 210 may for example process data stored on a storage media such as a memory device, an integrated circuit, a CD, a DVD etc to present this processed data in the form of the acoustic field for playback to the user 102.

The audio processing system 210 is configured to receive the primary acoustic signal c(t) from the primary microphone 106 and acoustic signals from one or more optional microphones, and process the acoustic signals. The audio processing system 210 is discussed in more detail below. The acoustic signals received by the primary microphone 106 and the secondary microphone 108 may be converted into electrical signals (i.e. a primary electrical signal and a secondary electrical signal). The electrical signals may themselves be converted by an analog-to-digital converter (not shown) into digital signals for processing in accordance with some embodiments. The primary acoustic signal c(t) and the secondary acoustic signal f(t) may be processed by the audio processing system 210 to produce a signal with an improved signal-to-noise ratio. It should be noted that embodiments of the technology described herein may be practiced utilizing only the primary microphone 106.

Figure 3:
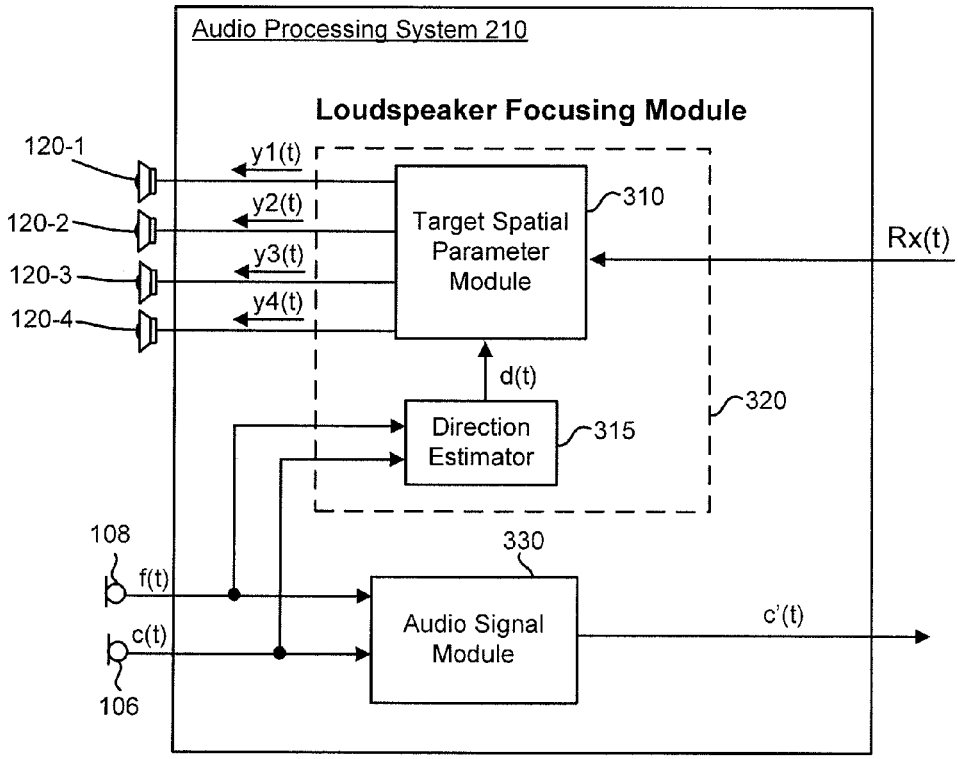
FIG. 3 is a block diagram of an exemplary audio processing system for producing an acoustic field having a target spatial pattern as described herein.

FIG. 3 is a block diagram of an exemplary audio processing system 210 for producing an acoustic field having a target spatial pattern as described herein. The audio processing system 210 may include loudspeaker focusing module 320 and audio signal module 330. The audio processing system 210 may include more or fewer components than those illustrated in FIG. 3, and the functionality of modules may be combined or expanded into fewer or additional modules. Exemplary lines of communication are illustrated between various modules of FIG. 3, and in other figures herein. The lines of communication are not intended to limit which modules are communicatively coupled with others, nor are they intended to limit the number and type of signals communicated between modules.

In operation, the primary acoustic signal c(t) received from the primary microphone 106 and the secondary acoustic signal f(t) received from the secondary microphone 108 are converted to electrical signals. The electrical signals are provided to the loudspeaker focusing module 320 and processed through the audio signal module 330.

In one embodiment, the audio signal module 330 takes the acoustic signals and mimics the frequency analysis of the cochlea (e.g., cochlear domain), simulated by a filter bank, for each time frame. The audio signal module 330 separates each of the primary acoustic signal c(t) and the secondary acoustic signal f(t) into two or more frequency sub-band signals. A sub-band signal is the result of a filtering operation on an input signal, where the bandwidth of the filter is narrower than the bandwidth of the signal received by the audio signal module 330. Alternatively, other filter banks such as short-time Fourier transform (STFT), sub-band filter banks, modulated complex lapped transforms, cochlear models, wavelets, etc., can be used for the frequency analysis and synthesis.

Because most sounds (e.g. acoustic signals) are complex and include multiple components at different frequencies, a sub-band analysis on the acoustic signal is useful to separate the signal into frequency bands and determine what individual frequency components are present in the complex acoustic signal during a frame (e.g. a predetermined period of time). For example, the length of a frame may be 4 ms, 8 ms, or some other length of time. In some embodiments there may be no frame at all. The results may include sub-band signals in a fast cochlea transform (FCT) domain. The sub-band frame signals of the primary acoustic signal c(t) is expressed as c(k), and the sub-band frame signals of the secondary acoustic signal f(t) is expressed as f(k). The sub-band frame signals c(k) and f(k) may be time and frame dependent, and may vary from one frame to the next.

The audio signal module 330 may process the sub-band frame signals to identify signal features, distinguish between speech components, noise components, and echo components, and generate one or more signal modifiers. The audio signal module 330 is responsible for modifying primary sub-band frame signals c(k) by applying the one or more signal modifiers, such as one or more multiplicative gain masks and/or subtractive operations. The modification may reduce noise and echo to preserve the desired speech components in the sub-band signals. Applying the echo and noise masks reduces the energy levels of noise and echo components in the primary sub-band frame signals c(k) to form masked sub-band frame signals c'(k).

The audio signal module 330 may convert the masked sub-band frame signals c'(k) from the cochlea domain back into the time domain to form a synthesized time domain noise and echo reduced acoustic signal c'(t). The conversion may include adding the masked frequency sub-band signals and may further include applying gains and/or phase shifts to the sub-band signals prior to the addition. Once conversion to the time domain is completed, the synthesized time-domain acoustic signal c'(t), wherein the noise and echo have been reduced, may be provided to a codec for encoding and subsequent transmission by the audio device 104 to the far-end environment 112 via the communications network 114.

In some embodiments, additional post-processing of the synthesized time-domain acoustic signal may be performed. For example, comfort noise generated by a comfort noise generator may be added to the synthesized acoustic signal prior to providing the signal to the user. Comfort noise may be a uniform constant noise that is not usually discernible to a listener (e.g., pink noise). This comfort noise may be added to the synthesized acoustic signal to enforce a threshold of audibility and to mask low-level non-stationary output noise components.

An example of the audio signal module 330 in some embodiments is disclosed in U.S. patent application Ser. No. 12/832,920 filed on Jul. 8, 2010 and entitled "Multi-Microphone Robust Noise Suppression", which is incorporated herein by reference. In exemplary embodiments, the audio processing system 210 is embodied within a memory device within audio device 104.

The primary acoustic signal c(t) and the secondary acoustic signal f(t) are provided to direction estimator module 315 in loudspeaker focusing module 320. The direction estimator module 315 computes the direction d(t) of a source (e.g. user 102) of a speech component within the primary acoustic signal c(t) and/or the secondary acoustic signal f(t) based on a difference between the primary acoustic signal c(t) and the secondary acoustic signal f(t). In some embodiments, the direction estimator 315 (also referred to as direction estimator module 315) receives information from the audio signal module 330 for use in determining the direction of a source of the speech component. This information may include for example the energy levels and phases of the sub-band signals c(k) and f(k). In other embodiments, the functionality of the direction estimator 315 is implemented within the audio signal module 330. In yet other embodiments in which the direction of a source is not determined, the direction estimator 315 may be omitted.

In the illustrated embodiment, the direction d(t) is determined based on a maximum of the cross-correlation between the primary acoustic signal c(t) and the secondary acoustic signal f(t). A maximum of the cross-correlation between the primary and secondary acoustic signals c(t), f(t) indicates the time delay between the arrival of the acoustic wave generated by the user 102 at the primary microphone 106 and at the secondary microphone 108. The time delay is dependent upon the distance Δ between the primary microphone 106 and the secondary microphone 108 and the angle of incidence of the acoustic wave generated by the user 102 upon the primary and secondary microphones 106, 108. For a known A and a time delay estimated according to the cross-correlation as described above, the angle of incidence can be estimated. The angle of incidence indicates the direction d(t) of the user 102. Other techniques for determining the angle of incidence may alternatively be used.

Alternatively, the direction of the user 102 may be determined in the transform domain. For example, a sub-band direction d(k) may be computed by the direction estimator module 315 based on amplitude and/or phase differences between the sub-band signals c(k) and f(k) in each sub-band which may be provided by the audio signal module 330. The direction estimator module 315 may compute frame energy estimations of the sub-band frame signals, sub-band inter-microphone level difference (sub-band ILD(k)), sub-band inter-microphone time differences (sub-band ITD(k)), and inter-microphone phase differences (sub-band IPD(k)) between the sub-band signals c(k) and the sub-band signals f(k). The direction estimator module 315 can then use one or more of the sub-band ILD(k), sub-band ITD(k) and sub-band IPD(k) to compute the sub-band d(k). The sub-band d(k) can change over time, and may vary from one frame to the next.

In some embodiments, the direction of an undesired listener such as undesired listener 103 may be determined as well. For example, the sub-band d(k) can also vary with sub-band index k within a particular time frame. This may occur, for example, when the primary and secondary acoustic signals c(t) and f(t) are each a superposition of two or more acoustic signals from sources at different locations. For example, a first set of one or more of the sub-band signals c(k), f(k) may be due to the user 102 at a first location, while a second set of one or more of the sub-band signals c(k), f(k) may be due to the undesired listener 103 at a second location. In such a case, the sub-band d(k) of the first set of sub-band signals c(k), f(k) indicates the direction of the user 102. Similarly, the sub-band d(k) of the second set of sub-band signals c(k), f(k) indicates the direction of the undesired listener 103. In embodiments in which there is overlap of the two or more sources in sub-band k (i.e. the two or more sources each have energy in sub-band k) a single direction d(k) for the sub-band may not be appropriate and further techniques may be applied to determine the directions of the user 102 and the undesired listener 103. These different sub-band d(k) can then be used to determine signal modifications applied to the signal Rx(t) to control of the spatial pattern of an acoustic field using the techniques described herein. For example, the acoustic energy of the acoustic field in regions of the spatial pattern which include the undesired listener 103 may be minimized, while satisfying other constraints on the acoustic energy in regions of the spatial pattern which includes the user 102 or other desired listener. As another example, the acoustic energy of the acoustic field in regions of the spatial pattern which include the user 102 may be maximized, while satisfying other constraints on the acoustic energy in regions of the spatial pattern which includes the undesired listener 103.

Determining energy levels and ILDs is discussed in more detail in U.S. patent application Ser. No. 11/343,524, entitled "System and Method for Utilizing Inter-Microphone Level Differences for Speech Enhancement", and U.S. patent application Ser. No. 12/832,920, entitled "Multi-Microphone Robust Noise Suppression", the disclosure of which is incorporated by reference.

The target spatial parameter module 310 receives the d(t) and the far-end acoustic signal Rx(t). As described in more detail below, the target spatial parameter module 310 applies signal modifications (e.g. filters, weights, time delays, etc.) to the far-end acoustic signal Rx(t) to form modified acoustic signals y(t). The signal modifications are configured such that the audio transducers 120 are responsive to the modified acoustic signals y(t) to form the acoustic field having the target spatial pattern, subject to a constraint on the resultant acoustic energy in one or more regions of the spatial pattern.

In the illustrated embodiment, there are four audio transducers 120-1 to 120-4. Thus, in the illustrated embodiment the target spatial parameter module 310 outputs four modified acoustic signals y1(*t*) to y4(*t*).

In embodiments, the parameter values of the signal modifications applied to the signal Rx(t) may be automatically and dynamically adjusted in real-time based on this d(t) of the user. This adjustment may include maximizing the acoustic energy of the acoustic field in the d(t) of the user 102 while satisfying constraints on the acoustic energy in one or more regions of the spatial pattern. As described above, the direction of the undesired listener may be also be determined by the direction estimator module 315 and provided to the target spatial parameter module 310. In such a case, the parameter values of the signal modifications applied to the signal Rx(t) may be automatically and dynamically adjusted in real-time further based on this direction of the undesired listener. This adjustment may include minimizing or constraining the acoustic energy of the acoustic field in the region which includes the direction of the undesired listener while satisfying the other constraints on the acoustic energy in one or more regions of the spatial pattern. As another example, this adjustment may include maximizing the acoustic energy of the acoustic field in the region which includes the direction of a desired listener and minimizing the acoustic energy of the acoustic field in the region which includes the direction of an undesired listener, while also constraining the acoustic energy of the acoustic field in one or more other regions.

The parameter values may for example be stored in the form of a look-up table in the memory within the audio device 104. As another example, the parameter values may be stored in the form of a derived approximate function. The parameter values as a function of d(t) may be derived for example mathematically, subject to the constraint(s) on the one or more regions of the target spatial pattern. Alternatively, the parameter values of the signal modifications may for example be determined empirically through calibration, or a combination of calibration and derivations.

The parameter values of the signal modifications may be determined mathematically utilizing a variety of different techniques. In some embodiments, the analysis is based on minimizing the acoustic energy of the acoustic field in the one or more constrained region(s) of the target spatial pattern. The analysis may be further or alternatively based on maximizing the acoustic energy of the acoustic field in one or more desired region(s) of the target spatial pattern, such as the direction of the user 102.

In one embodiment, the analysis is based on constrained optimization and generalized eigenvalues, as described below. In a given two-dimensional plane, the spatial pattern A(ω,θ) of the composite acoustic signal for a line of transducers may be expressed mathematically as:

$$A(\omega, \theta) = V(\omega, \theta)\sum_{n=1}^{N} a_n(\omega)e^{-j\omega\frac{x_n}{c}\sin\theta} \qquad \text{Equation (1)}$$

where V(ω,θ) is the response of an audio transducer 130 as a function of frequency ω and angle θ relative to an axis perpendicular to the line of transducers, $x_n$ is the relative position of audio transducer **130-*n* which in this example is from a center of the line of transducers, c is the speed of sound, N is the number of audio transducers 120 generating acoustic waves 130, and $a_n(\omega)$ is the signal modification applied to form the modified signal yn(t) which is provided to audio transducer 130-*n*. In the equation above, the response V(ω,θ) is assumed to be the same for each audio transducer 130-*n***. More generally, the response of each individual audio transducer $V_n(\omega, \theta)$ may be used within the summation equation.

In matrix form, equation (1) may be represented mathematically as:

$$A(\omega,\theta)=E(\omega,\theta)a(\omega) \qquad \text{Equation (2)}$$

where a(ω) is the set of signal modifications $a_n(\omega)$ in vector form, and E(ω,θ) is the matrix form of the remaining portions of Equation 1.

The signal modifications $a_n$ may then be derived to maximize the spatial pattern $A_D(\omega,\theta)$ in one or more desired regions $\theta_D$, subject to a constraint in the spatial pattern $A_U(\omega, \theta)$ in one or more constrained regions $\theta_U$. It should be noted that in some embodiments, the desired regions $\theta_D$ and the constrained regions $\theta_U$ may not encompass the entire range of θ. In other words, in some embodiments there may also be one or more "don't care" regions of θ. In some embodiments, the regions $\theta_D$ and $\theta_U$ may be a function of the frequency ω.

The energy $P_\Omega(\omega)$ delivered to a spatial region $\Omega$ may be represented mathematically as:

$$P_\Omega(\omega) = \int_{\theta\in\Omega} |A(\omega, \theta)|^2 d\theta \approx \sum_{\theta\in\Omega} |A(\omega, \theta)|^2 \quad \text{Equation (3)}$$

The right side of Equation 3 may be expressed mathematically as:

$$\sum_{\theta\in\Omega} |A(\omega, \theta)|^2 = a(\omega)^H E^H_{\theta\in\Omega} E_{\theta\in\Omega} a(\omega) \quad \text{Equation (4)}$$

where $E_{\theta\in\Omega}$ is the matrix $E(\omega,\theta)$ for $\theta\in\Omega$, and H designates the Hermitian transpose of a matrix.

Thus, the energy $P_D(\omega)$ within the desired regions $\theta_D$ and the energy $P_U(\omega)$ within the undesired regions $\theta_U$ may be expressed mathematically as:

$$P_D(\omega)=a(\omega)^H E_{\theta\in\theta_D} E_{\theta\in\theta_D} a(\omega) \quad \text{Equation (5)}$$

$$P_U(\omega)=a(\omega)^H E_{\theta\in\theta_D} E_{\theta\in\theta_D} a(\omega) \quad \text{Equation (6)}$$

Constrained optimization may then be carried out to maximize $P_D(\omega)$ subject to a constraint C on $P_U(\omega)$. This optimization can take the form of a Lagrange multiplier optimization function which may be expressed mathematically as:

$$J=P_D(\omega)-\lambda(P_U(\omega)-C) \quad \text{Equation (7)}$$

$$J=a(\omega)^H M_D a(\omega)-\lambda(a(\omega)^H M_U a(\omega)-C) \quad \text{Equation (8)}$$

where $M_D$ and $M_U$ are functions of $\omega$ and $\theta$ and can be seen by comparison Equation 8 with Equations 5 and 6 respectively.

Setting the derivative of Equation 8 with respect to $a^H$ to 0 results in the generalized eigenvalue equation which can be represented mathematically as:

$$M_D a(\omega)=\lambda M_S a(\omega) \quad \text{Equation (9)}$$

The solution to equation (9) may then be solved as a generalized eigenvalue problem. The solution also satisfies the relationship:

$$\lambda = \frac{a^H(\omega)M_D a(\omega)}{a^H(\omega)M_S a(\omega)} = \frac{a^H(\omega)M_D a(\omega)}{C} \quad \text{Equation (10)}$$

In instances in which Equation (9) includes more than one solution for the eigenvector a, the solution with the largest eigenvalue results in the maximum energy $P_D(\omega)$ within the desired regions $\theta_D$. The solution with the largest eigenvalue provides the signal modifications $a_n(\omega)$, where $a_n(\omega)$ is the nth element of the vector $a(\omega)$. Once the signal modifications $a_n(\omega)$ are derived, filters or other techniques for applying the signal modifications may be designed based on a least-squares fit analysis.

The signal modifications an may be derived at a single frequencies $\omega_1$, and then a filter may be designed to maintain that signal modification response across a band of frequencies. Alternatively, the signal modifications $a_n$ may be derived at various frequencies across a band, and interpolation may be used to determine the signal modifications $a_n$ at other frequencies in the band.

Figure 4:
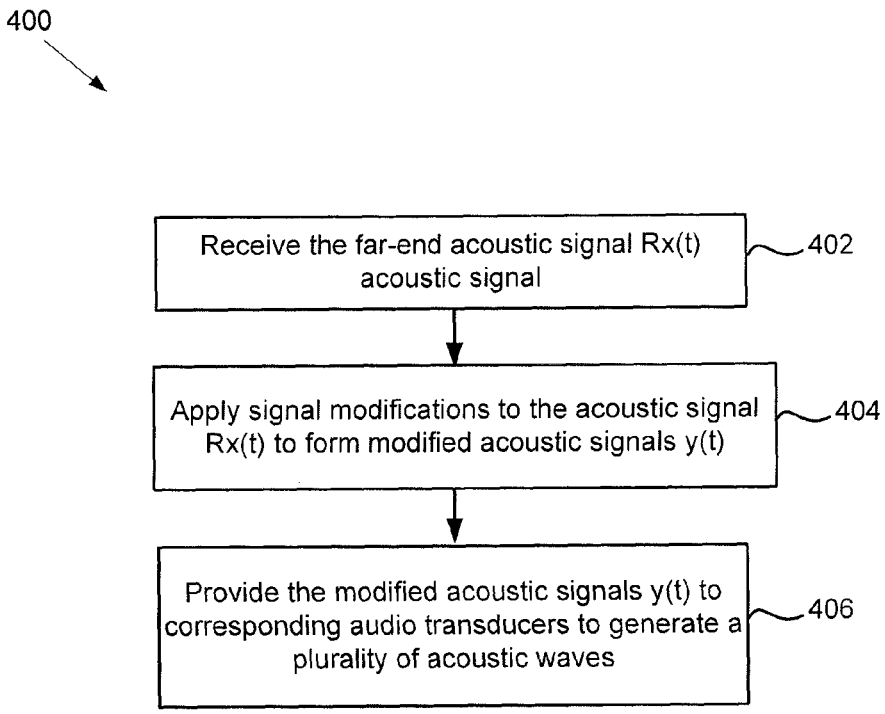
FIG. 4 is a flow chart of an exemplary method for producing an acoustic field having a target spatial pattern.

FIG. 4 is a flow chart of an exemplary method 400 for producing an acoustic field having a target spatial pattern as described herein. As with all flow charts herein, in some embodiments steps in FIG. 4 can be combined, performed in parallel, or performed in a different order, and the method of FIG. 4 may include additional or fewer steps than those illustrated.

In step 402, the far-end acoustic signal Rx(t) is received via the communication network 114. In some embodiments, the primary acoustic signal c(t) is received by the primary microphone 106 and the secondary acoustic signal f(t) is received by the secondary microphone 108. In exemplary embodiments, the acoustic signals are converted to digital format for processing.

In step 404, signal modifications as described herein are applied to the far-end acoustic signal Rx(t) to form modified acoustic signals y(t).

In step 406, modified acoustic signals y(t) are provided to the audio transducers 120 to generate the acoustic waves 130. The acoustic waves 130 form an acoustic interference pattern producing an acoustic field with the target spatial pattern.

Figure 5:
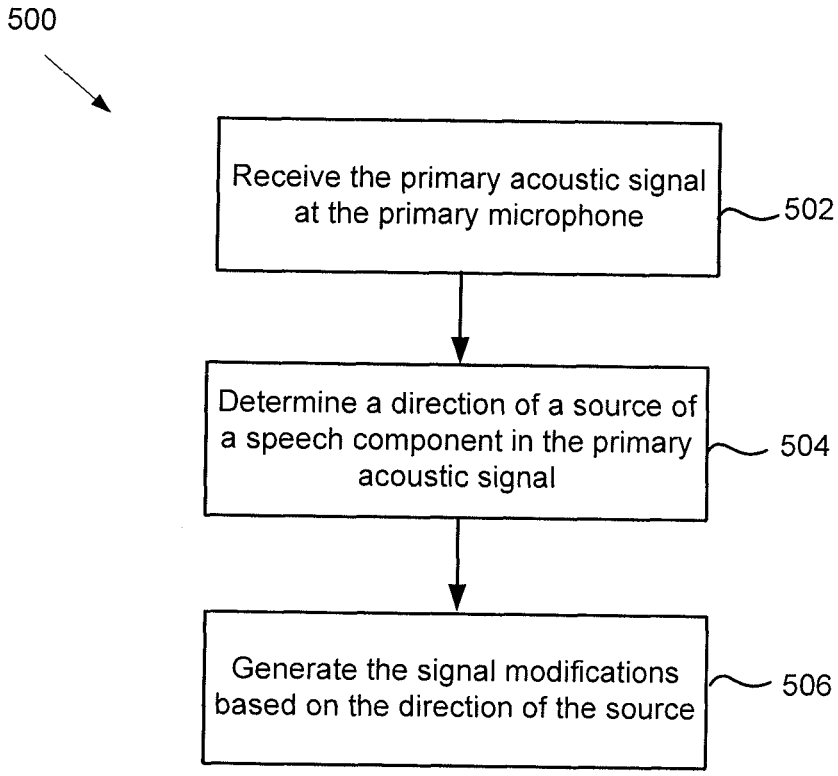
FIG. 5 is a flow chart of an exemplary method for generating signal modifications based on the direction of a speech source.

FIG. 5 is a flow chart of an exemplary method 500 for generating signal modifications based on the direction of a speech source (e.g., the user 102). In step 502, the primary acoustic signal c(t) is received at the primary microphone 106.

In step 504, the direction of a source of the speech component in the primary acoustic signal is derived based on characteristics of the primary acoustic signal c(t). In embodiments in which the audio device 104 includes a single microphone, the direction may be determined for example in conjunction with an image capture device such as a video camera on the audio device 104 as described above. In embodiments in which the audio device 104 includes the secondary microphone 108, the direction may be determined using the techniques described above based on a difference between the primary and secondary acoustic signals c(t) and f(t).

In step 506, the signal modifications applied in step 404 in FIG. 4 are determined based on the direction of the speech source. The parameter values may for example be determined through the use of a look-up table stored in the memory within the audio device 104. As another example, the parameter values may be stored in the form of a derived approximate function.

Figure 6A:
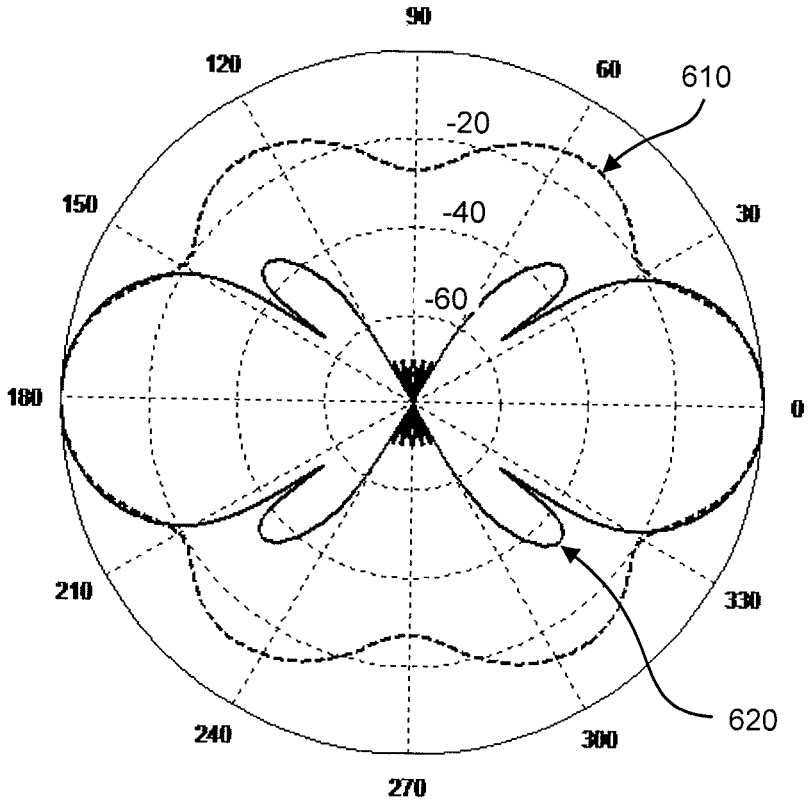
FIGS. 6A and 6B each illustrate a two dimensional plot of exemplary target spatial patterns for the acoustic field.

FIG. 6A illustrates a two dimensional plot of an exemplary normalized computed target spatial pattern 620 on a dB scale. In FIG. 6A, the target spatial pattern 620 includes two constrained regions, the first being between the angles 60 and 120, and the second being between the angles −120 and −60. Subject to those constraints, the signal modifications applied to form the modified acoustic signals y(t) are configured to maximize the energy of the acoustic field within a target region between the angles of −30 to 30 degrees. In the illustrated example, the target spatial pattern 620 it a frequency of 1 kHz and was formed utilizing an array of 8 audio transducer elements 120 at positions $x_n$ of −40 cm, −20 cm, −10 cm, −3 cm, 3 cm, 10 cm, 20 cm and 40 cm from the center of the array. The corresponding signal modifications an for each audio transducer 120 in the array that were applied to generate the target spatial pattern 620 were 0.2927, 1.0, −0.1749, 0.7910, 0.7910, −0.1749, 1.0 and 0.2927. Also illustrated in FIG. 6A is a spatial pattern 610 if identical signals are applied to each of the audio transducers which were used to form the target spatial pattern 620.

Figure 6B:
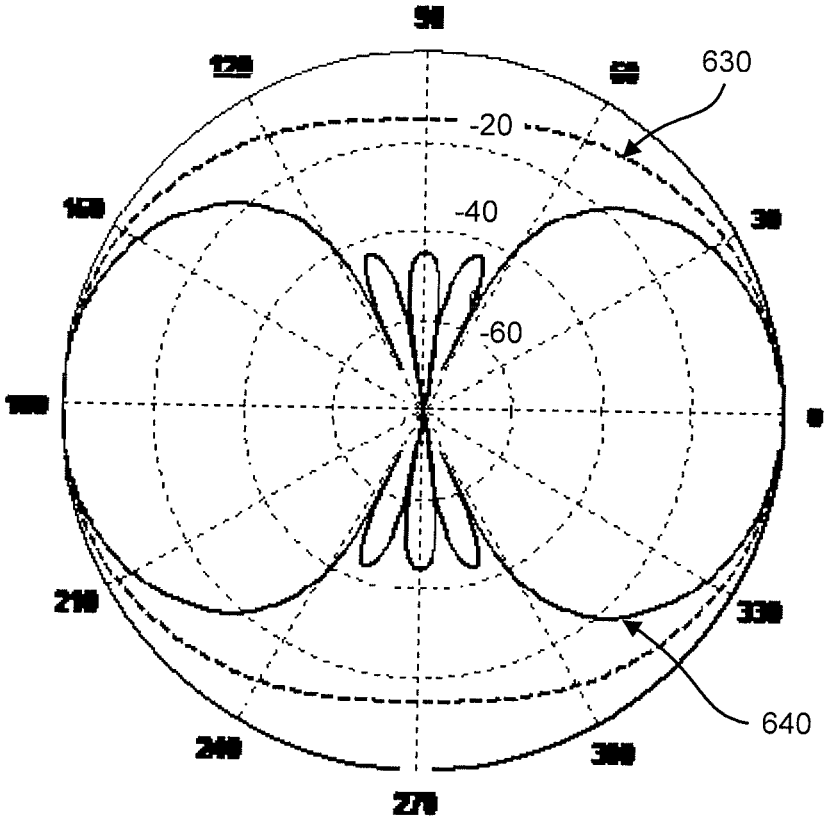

FIG. 6B illustrates a two dimensional plot of a second exemplary normalized computed target spatial pattern 640 on a dB scale. Similar to FIG. 6A, the target spatial pattern 640 includes two constrained regions, the first being between the angles 60 and 120, and the second being between the angles −120 and −60. Subject to those constraints, the signal modifications applied to form the modified acoustic signals y(t) are configured to maximize the energy of the acoustic field within a target region between the angles of −30 to 30 degrees. In the illustrated example in FIG. 6B, the target spatial pattern 640 it a frequency of 1 kHz and was formed utilizing an array of 6 audio transducer elements 120 at positions $x_n$ of −12 cm, −7 cm, −3 cm, 3 cm, 7 cm and 12 cm from the center of the array. The corresponding signal modifications $a_n$ for each audio transducer 120 in the array that were applied to generate the target spatial pattern 640 were −0.5307, 1.00, −0.6996, 1.00 and −0.5307. Also illustrated in FIG. 6B is a spatial pattern 630 if identical signals are applied to each of the audio transducers which were used to form the spatial pattern 640.

Figure 7:
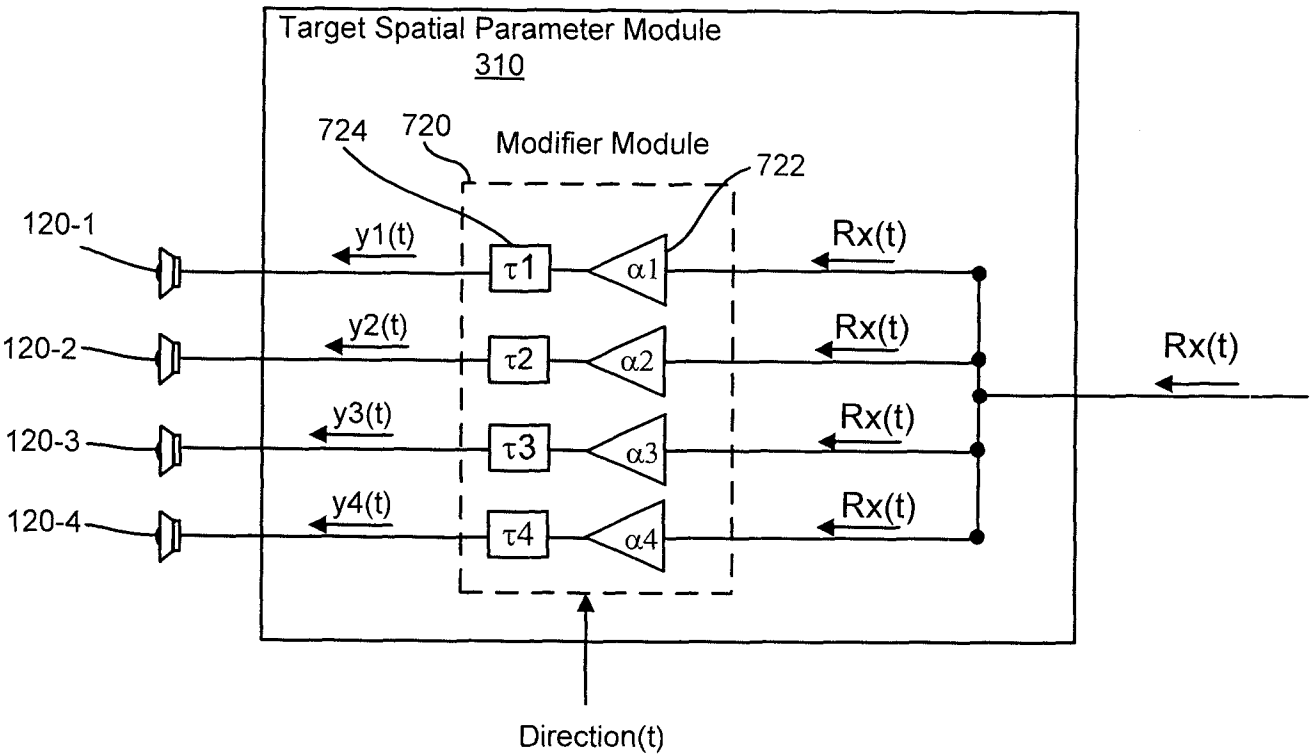
FIG. 7 illustrates an exemplary block diagram of an exemplary target spatial parameter module.

FIG. 7 is an exemplary block diagram of the target spatial parameter module 310. The target spatial parameter module 310 includes modifier module 720. The target spatial parameter module 310 may include more components than those illustrated in FIG. 7, and the functionality of modules may be combined or expanded into additional modules.

The modifier module 720 applies the signal modifications to the far-end acoustic signal Rx(t) to form the modified acoustic signals y(t). The modification of acoustic signal y1(*t*) is representative of a modification applied to the far-end acoustic signal Rx(t). As shown in FIG. 7, a weighting module 722 applies a coefficient al to the far-end acoustic signal Rx(t), and the delay module 724 delays the result by a time delay τ1 to form the modified signal y1(*t*). The modified signal y1(*t*) is then provided to the audio transducer 120-1 to generate the acoustic wave 130-1. As described above, the coefficient al and the time delay τ1 may be dependent upon the d(t) provided by the direction estimator module 315. The coefficient al may also be frequency dependent, in which case the coefficients α1(ω) correspond to a filter.

In the illustrated embodiment, the modified acoustic signals y(t) are formed by modifying the acoustic signals Rx(t) in the time domain. Alternatively, the acoustic signal Rx(t) may for example be modified in a transform domain and converted to the time domain to form the modified acoustic signals y(t).

The above described modules may be comprised of instructions that are stored in a storage media such as a machine readable medium (e.g., computer readable medium). These instructions may be retrieved and executed by the processor 202. Some examples of instructions include software, program code, and firmware. Some examples of storage media comprise memory devices and integrated circuits. The instructions are operational.

As used herein, a given signal, event or value is "based on" a predecessor signal, event or value if the predecessor signal, event or value influenced the given signal, event or value. If there is an intervening processing element, step or time period, the given signal can still be "based on" the predecessor signal, event or value. If the intervening processing element or step combines more than one signal, event or value, the output of the processing element or step is considered to be "based on" each of the signal, event or value inputs. If the given signal, event or value is the same as the predecessor signal, event or value, this is merely a degenerate case in which the given signal, event or value is still considered to be "based on" the predecessor signal, event or value. "Dependency" on or being "dependent upon" a given signal, event or value upon another signal, event or value is defined similarly.

While the present invention is disclosed by reference to the preferred embodiments and examples detailed above, it is to be understood that these examples are intended in an illustrative rather than a limiting sense. It is contemplated that modifications and combinations will readily occur to those skilled in the art, which modifications and combinations will be within the spirit of the invention and the scope of the following claims.

What is claimed is:

1. A method for producing an acoustic field having a target spatial pattern, the method comprising:

receiving a first acoustic signal;

applying signal modifications to the first acoustic signal to form corresponding modified acoustic signals, the signal modifications based on a constraint for the acoustic field in a particular region of the target spatial pattern; and providing the modified acoustic signals to corresponding audio transducers in a plurality of audio transducers to generate a plurality of acoustic waves, the plurality of acoustic waves producing the acoustic field with the target spatial pattern.

2. The method of claim 1, wherein the signal modifications are based on constraining acoustic energy of the acoustic field in the particular region of the target spatial pattern to be at or below a threshold.

3. The method of claim 2, wherein the signal modifications are further based on maximizing acoustic energy of the acoustic field in a second particular region of the target spatial pattern.

4. The method of claim 1, wherein the signal modifications are based on constraining acoustic energy of the acoustic field in the particular region of the target spatial pattern to be at or above a threshold, and further based on minimizing acoustic energy of the acoustic field in a second particular region of the target spatial pattern.

5. The method of claim 1, further comprising:

receiving a primary acoustic wave at a microphone to form a second acoustic signal, the primary acoustic wave including a speech component;

analyzing the second acoustic signal to determine a direction of a source of the speech component in the primary acoustic wave; and generating the signal modifications based on the determined direction of the source.

6. The method of claim 5, wherein the signal modifications are adapted to maximize acoustic energy of the acoustic field in the determined direction of the source.

7. The method of claim 5, further comprising receiving the primary acoustic wave at a second microphone to form a third acoustic signal, and further analyzing the third acoustic signal to determine the direction of the source of the speech component.

8. The method of claim 7, wherein determining the direction of the source of the speech component is based on at least one of an amplitude difference and a phase difference between the second acoustic signal and the third acoustic signal.

9. The method of claim 7, wherein determining the direction of the source of the speech component is based on a time delay estimation between the second acoustic signal and the third acoustic signal.

10. A system for producing an acoustic field having a target spatial pattern, the system comprising:

an audio processing system that receives a first acoustic signal, and applies signal modifications to the first acoustic signal to form corresponding modified acoustic signals, the signal modifications based on a constraint for the acoustic field in a particular region of the target spatial pattern; and a plurality of audio transducers that generate a plurality of acoustic waves in response to the modified acoustic signals, the plurality of acoustic waves producing the acoustic field with the target spatial pattern.

11. The system of claim 10, wherein the signal modifications are based on constraining acoustic energy of the acoustic field in the particular region of the target spatial pattern to be at or below a threshold.

12. The system of claim 11, wherein the signal modifications are further based on maximizing acoustic energy of the acoustic field in a second particular region of the target spatial pattern.

13. The system of claim 10, wherein the signal modifications are based on constraining acoustic energy of the acoustic field in the particular region of the target spatial pattern to be at or above a threshold, and further based on minimizing acoustic energy of the acoustic field in a second particular region of the target spatial pattern.

14. The system of claim 10, further comprising a microphone to receive a primary acoustic wave to form a second acoustic signal, the primary acoustic wave including a speech component, and wherein the audio processing system analyzes the second acoustic signal to determine a direction of a source of the speech component in the primary acoustic wave, and generates the signal modifications based on the determined direction of the source.

15. The system of claim 14, wherein the signal modifications are adapted to maximize acoustic energy of the acoustic field in the determined direction of the sources subject to the constraint in the particular region.

16. The system of claim 14, further comprising a second microphone to receive the primary acoustic wave to form a third acoustic signal, and wherein the audio processing system further analyzes the third acoustic signal to determine the direction of the source of the speech component.

17. The system of claim 16, wherein determining the direction of the source of the speech component is based on at least one of an amplitude difference and a phase difference between the second acoustic signal and the third acoustic signal.

18. The system of claim 16, wherein determining the direction of the source of the speech component is based on a time delay estimation between the second acoustic signal and the third acoustic signal.

19. A non-transitory computer readable storage medium having embodied thereon a program, the program being executable by a processor to perform a method for producing an acoustic field having a target spatial pattern, the method comprising:

receiving a first acoustic signal;

applying signal modifications to the first acoustic signal to form corresponding modified acoustic signals, the signal modifications based on a constraint for the acoustic field in a particular region of the target spatial pattern; and providing the modified acoustic signals to corresponding audio transducers in a plurality of audio transducers to generate a plurality of acoustic waves, the plurality of acoustic waves forming an acoustic interference pattern producing the acoustic field with the target spatial pattern.

20. The non-transitory computer readable storage medium of claim 19, wherein the signal modifications are based on minimizing acoustic energy of the acoustic field in the particular region of the target spatial pattern.

* * * * *